US010634391B2

(12) United States Patent
Mislak

(10) Patent No.: US 10,634,391 B2
(45) Date of Patent: Apr. 28, 2020

(54) SUPPLEMENTAL HEATING AND COOLING SYSTEM

(71) Applicant: Johnson Controls Technology Company, Milwaukee, WI (US)

(72) Inventor: Nicholas P. Mislak, Bel Air, MD (US)

(73) Assignee: Johnson Controls Technology Company, Auburn Hills, MI (US)

( * ) Notice: Subject to any disclaimer, the term of this patent is extended or adjusted under 35 U.S.C. 154(b) by 69 days.

(21) Appl. No.: 15/716,176

(22) Filed: Sep. 26, 2017

(65) Prior Publication Data

US 2018/0106505 A1 Apr. 19, 2018

Related U.S. Application Data

(60) Provisional application No. 62/407,905, filed on Oct. 13, 2016.

(51) Int. Cl.
*F25B 5/02* (2006.01)
*F25B 5/00* (2006.01)
(Continued)

(52) U.S. Cl.
CPC ..... *F25B 5/00* (2013.01); *F25B 5/02* (2013.01); *F25B 41/04* (2013.01); *F25B 49/02* (2013.01); *F25B 2400/13* (2013.01); *F25B 2600/2507* (2013.01); *F25B 2600/2509* (2013.01); *F25B 2600/2511* (2013.01)

(58) Field of Classification Search
CPC ..... F25B 5/00; F25B 5/02; F25B 5/04; F25B 29/003; F25B 29/029; F25B 2313/021; F25B 2313/02131; F25B 2600/2511
See application file for complete search history.

(56) References Cited

U.S. PATENT DOCUMENTS 6,591,902 B1 7/2003 Trent
6,658,874 B1 12/2003 Trent
(Continued)

FOREIGN PATENT DOCUMENTS

WO 2015131184 A1 9/2015

OTHER PUBLICATIONS

Taras, Michael F., "Comparison of Reheat Strategies for Constant Volume Rooftop Units", Mar. 2008.

*Primary Examiner* — Jonathan Bradford
(74) *Attorney, Agent, or Firm* — Fletcher Yoder, P.C.

(57) ABSTRACT

A vapor compression system that includes an evaporator system that changes a temperature of a fluid flowing across the evaporator system using a refrigerant. The evaporator system includes a first evaporator section that cools the fluid flowing across the first evaporator section using the refrigerant. The evaporator system also includes a second evaporator section that is capable of alternatively cooling and heating the fluid flowing across the second evaporator section with the refrigerant. A valve system controls a flow of the refrigerant through the second evaporator section between a first flow path of the evaporator system and a second flow path of the evaporator system. The refrigerant heats the fluid flowing across the second evaporator section as the refrigerant flows through the first flow path and the refrigerant cools the fluid flowing across the second evaporator section as the refrigerant flows through the second flow path.

6 Claims, 7 Drawing Sheets

(51) Int. Cl.
*F25B 49/02* (2006.01)
*F25B 41/04* (2006.01)

(56) References Cited

U.S. PATENT DOCUMENTS

| | | | | |
|---|---|---|---|---|
| 7,845,185 | B2 | 12/2010 | Knight et al. | |
| 8,397,522 | B2 | 3/2013 | Springer et al. | |
| 8,640,472 | B2 | 2/2014 | Dieckmann et al. | |
| 9,822,994 | B2 * | 11/2017 | Yanachi | F25B 13/00 |
| 2011/0100035 | A1 | 5/2011 | Taras et al. | |
| 2012/0085114 | A1 * | 4/2012 | Graaf | B60H 1/00278 62/238.7 |
| 2016/0273815 | A1 | 9/2016 | Downie et al. | |

* cited by examiner

SUPPLEMENTAL HEATING AND COOLING SYSTEM

CROSS-REFERENCE TO RELATED APPLICATION

This application is a Non-Provisional Application claiming priority to U.S. Provisional Application No. 62/407,072, entitled "COMBINED COOLING AND REHEAT COIL CYCLE FOR AIR CONDITIONING APPARATUS," filed Oct. 13, 2016, which is hereby incorporated by reference in its entirety for all purposes.

BACKGROUND

The present disclosure relates generally to heat exchangers in vapor compression systems.

Heat exchangers are used in heating, ventilation, and air conditioning (HVAC) systems to exchange energy between fluids. Typical HVAC systems have two heat exchangers commonly referred to as an evaporator coil and a condenser coil. The evaporator coil and the condenser coil facilitate heat transfer between air surrounding the coils and a refrigerant that flows through the coils. For example, as air passes over the evaporator coil, the air cools as it loses energy to the refrigerant passing through the evaporator coil. In contrast, the condenser facilitates the discharge of heat from the refrigerant to the surrounding air. Unfortunately, HVAC&R systems condition air by repeatedly turning on and off.

SUMMARY

The present disclosure relates to a vapor compression system that includes an evaporator system that changes a temperature of a fluid flowing across the evaporator system using a refrigerant. The evaporator system includes a first evaporator section that cools the fluid flowing across the first evaporator section using the refrigerant. The evaporator system also includes a second evaporator section that capable of alternatively cooling and heat the fluid flowing across the second evaporator section with the refrigerant. A valve system controls a flow of the refrigerant through the second evaporator section between a first flow path of the evaporator system and a second flow path of the evaporator system. The refrigerant heats the fluid flowing across the second evaporator section as the refrigerant flows through the first flow path and the refrigerant cools the fluid flowing across the second evaporator section as the refrigerant flows through the second flow path.

The present disclosure also relates to a vapor compression system that includes an evaporator system that changes a temperature of a fluid flowing across the evaporator system using a refrigerant. The evaporator system includes a first evaporator section that cools the fluid flowing through the first evaporator section using the refrigerant. The evaporator system also includes a second evaporator section capable of alternatively cooling and heating or simultaneously cooling and heating the fluid flowing through the second evaporator section with the refrigerant. The second evaporator section includes a first flow path that heats the fluid flowing across the evaporator system with the refrigerant and a second flow path that cools the fluid flowing across the evaporator system with the refrigerant. A modulating valve fluidly couples to the first and second flow paths and controls the flow of the refrigerant through the first and second flow paths.

The present disclosure also relates to a vapor compression system that includes an evaporator system that changes a temperature of a fluid flowing across an evaporator system using a refrigerant. The evaporator system includes a first evaporator section that cools the fluid flowing across the first evaporator section using the refrigerant. The evaporator system also includes a second evaporator section that cools a first portion of the fluid flowing across the first evaporator section with the refrigerant. The evaporator system also includes a third evaporator section that heats a second portion of the fluid flowing across the first evaporator section with the refrigerant. A modulating valve fluidly coupled to the second evaporator section and the third evaporator section controls the flow of the refrigerant through the second evaporator section and the third evaporator section.

DRAWINGS

DETAILED DESCRIPTION

Embodiments of the present disclosure include an HVAC system with a supplemental heating and cooling system that enables adjustment of a supply air stream's characteristics. These characteristics may include humidity level, temperature, etc. In the embodiments discussed below, the HVAC system includes an evaporator system with multiple sections. One or more of these sections provide supplemental cooling, reheating, or supplemental cooling and reheating. That is, after the supply air stream passes through a primary cooling evaporator section, the supply air stream then flows through one or more additional sections that either reheat and/or provide supplemental cooling of the supply air stream. In order to control the flow of refrigerant through these additional sections, the HVAC system may include a valve system controlled by a controller. In operation, the controller opens and closes the valves in the valve system to increase and/or decrease the flow refrigerant through the additional sections of the evaporator system. In some embodiments, the valve system may control the direction of refrigerant flow through the additional sections in order to transition the additional sections between reheat and cooling modes.

Figure 1:
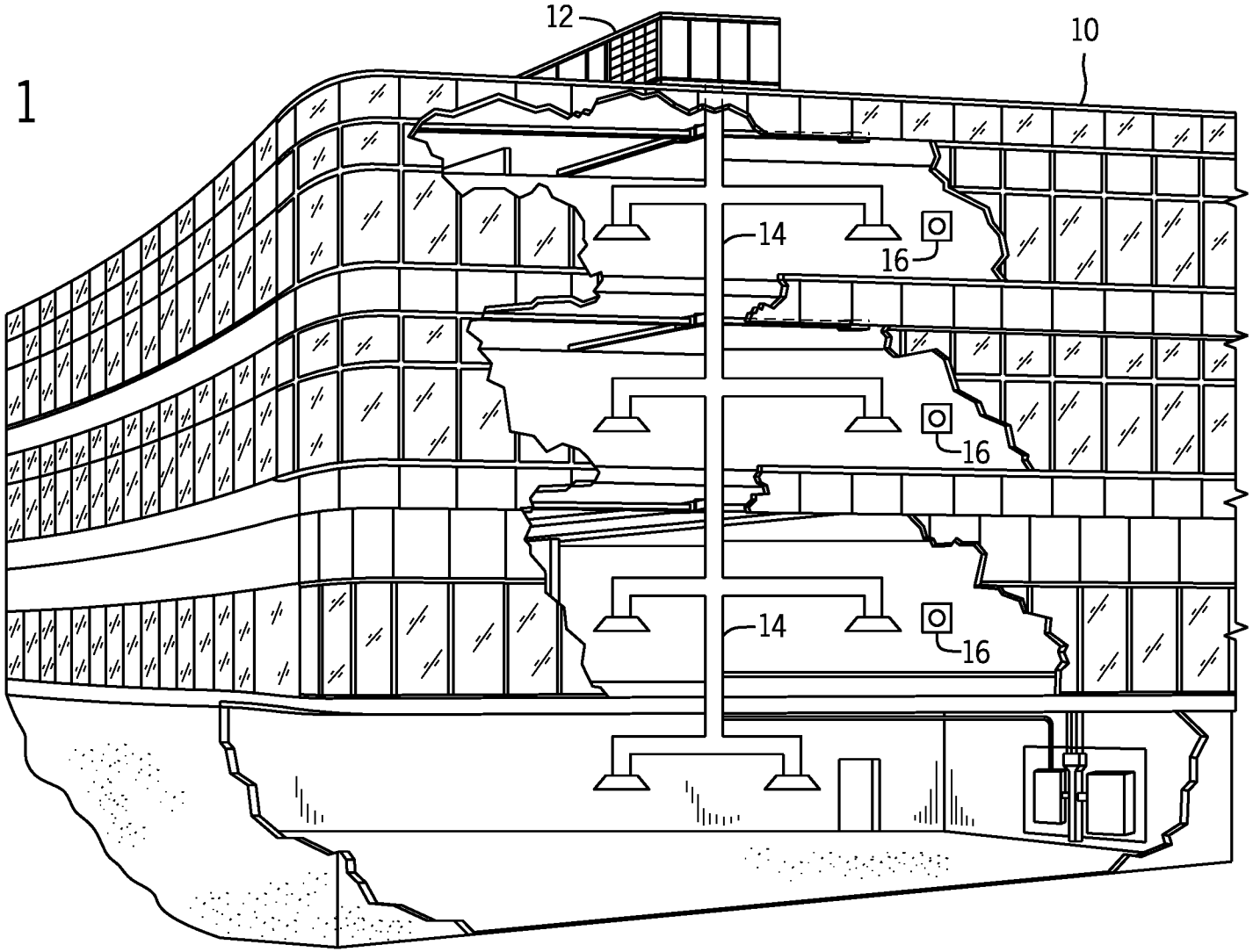
FIG. 1 is a perspective view of an embodiment of a building that may utilize a heating, ventilation, and air conditioning (HVAC) system in a commercial setting, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
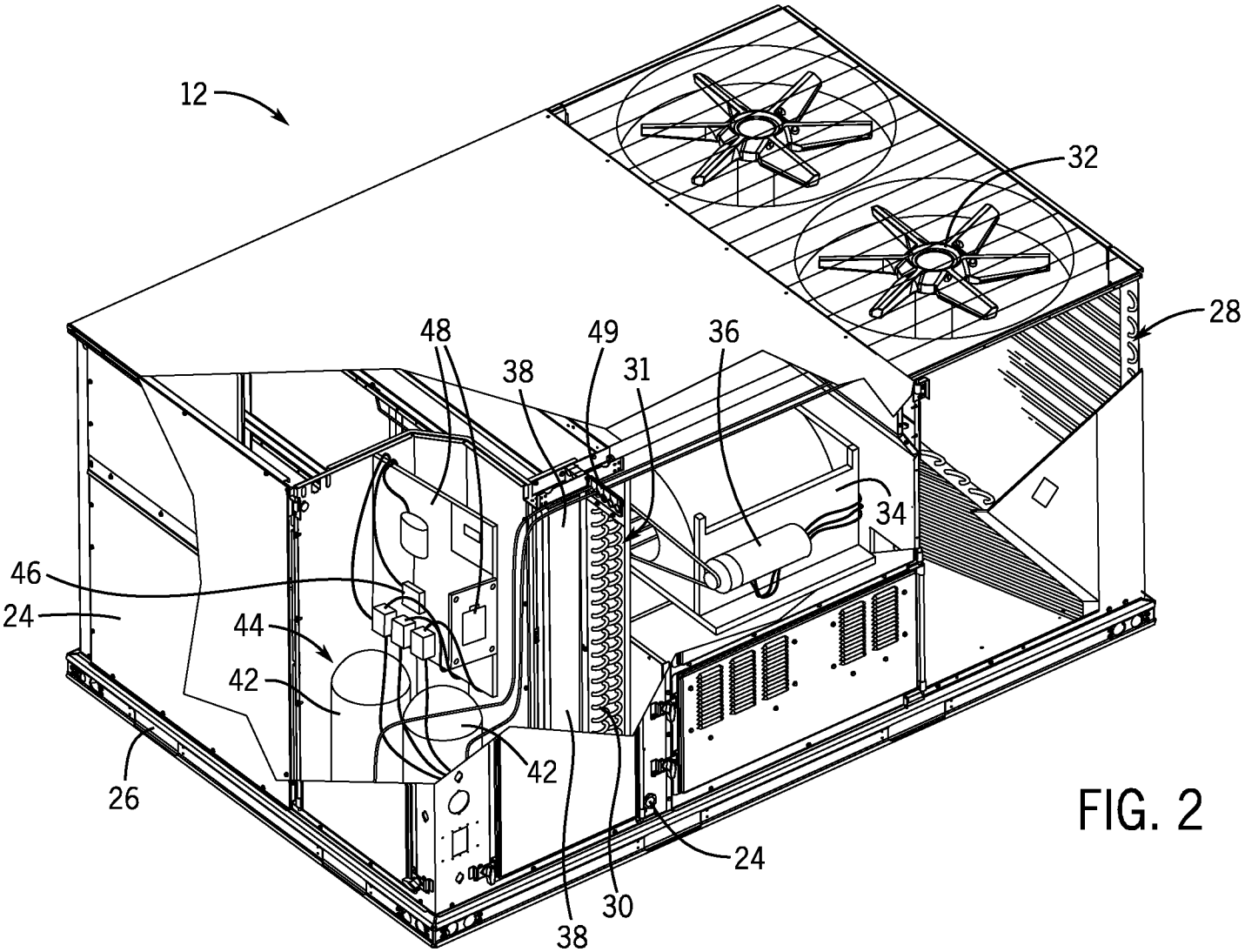
FIG. 2 is a perspective view of an embodiment of an HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive him arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
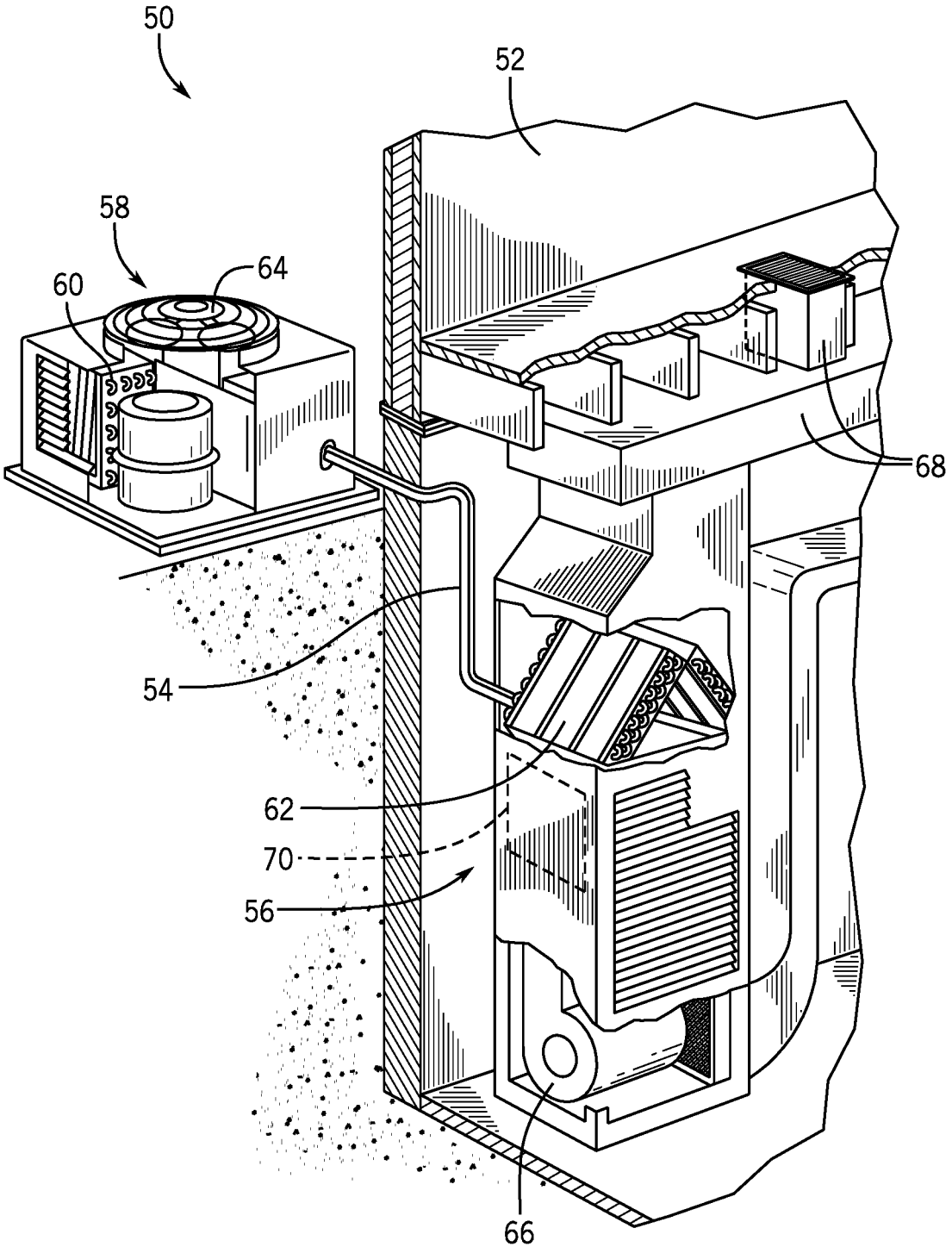
FIG. 3 is a perspective view of an embodiment of a residential, split HVAC system that includes an indoor HVAC unit and an outdoor HVAC unit, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
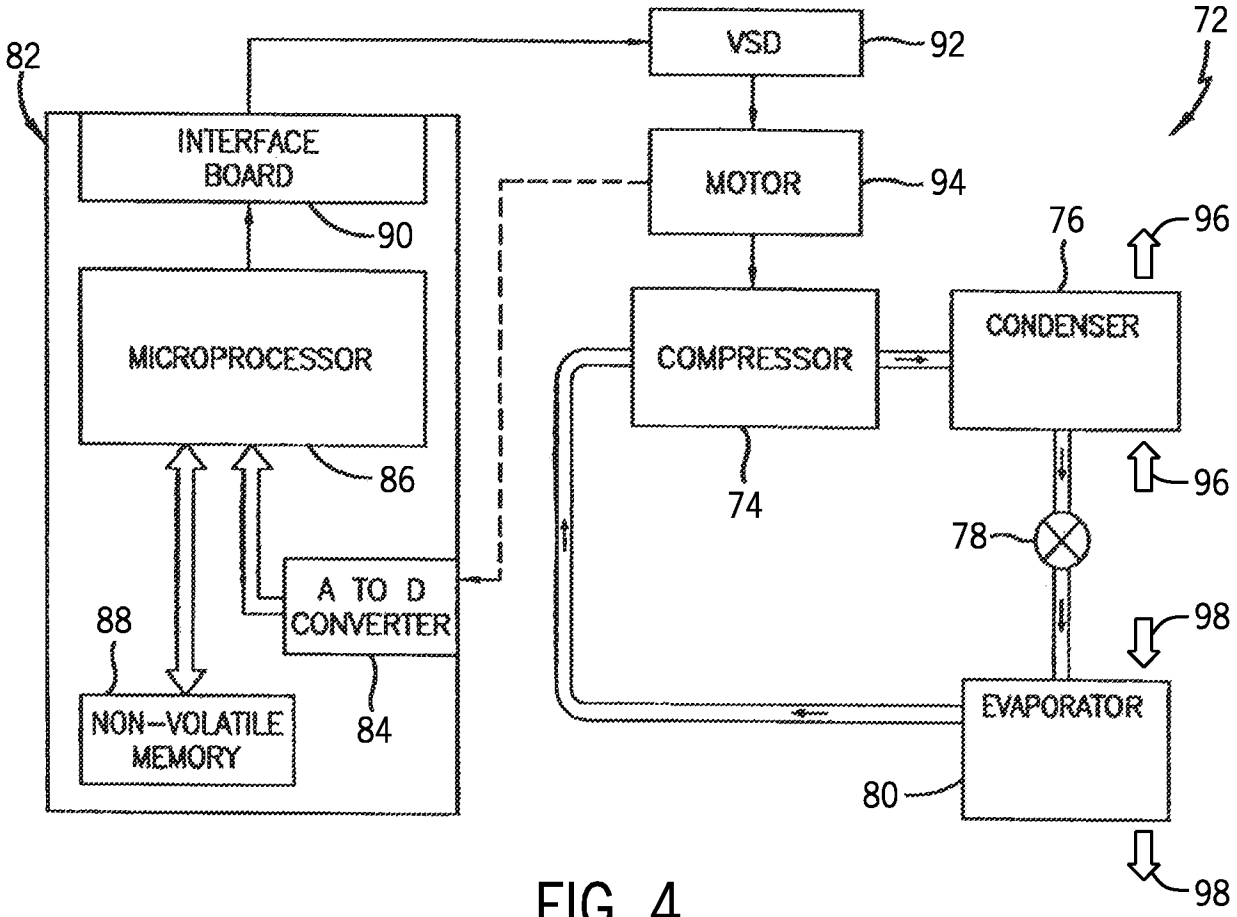
FIG. 4 is a schematic of an embodiment of an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
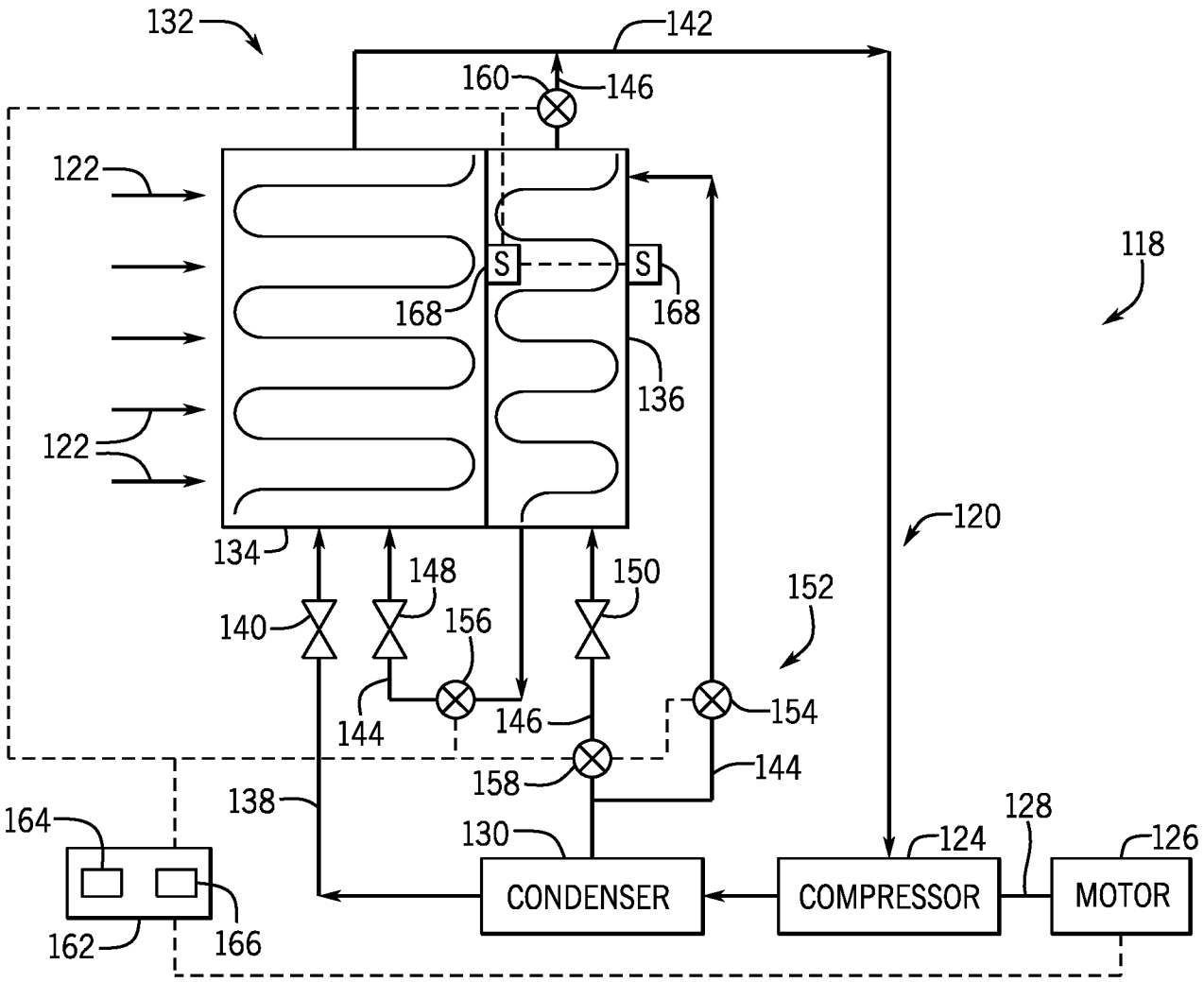
FIG. 5 is a schematic of an embodiment of the HVAC system, in accordance with an aspect of the present disclosure.

FIG. 5 is an embodiment of a vapor compression system 118 that can be used in any of the systems described above in FIGS. 1-4. In operation, the vapor compression system 118 circulates a refrigerant in a refrigeration loop to cool a supply air stream 122. As will be described in detail below, the vapor compression system 118 includes a supplemental heating and cooling system 120 that enables the vapor compression system 118 to further control the characteristics (e.g., temperature, humidity) of the supply air stream 122.

The refrigeration loop begins with a compressor 124 that compresses and drives refrigerant through the refrigeration loop using power generated by the motor 126. As illustrated, a motor 126 couples to the compressor 124 with a shaft 128. As the motor 126 rotates the shaft 128, the motor 126 transfers power through the shaft 128 to the compressor 124. The motor 126 may be an electric motor, gas powered motor, diesel motor, etc. After passing through the compressor 124, the refrigerant flows to a condenser 130. In the condenser 130, the refrigerant rejects heat, thereby enabling the refrigerant to condense and change from a gaseous to a liquid state. The refrigerant then exits the condenser 130 and enters the evaporator system 132. In the evaporator system 132, the vapor compression system 118 changes the temperature of the supply air stream 122 through heat transfer with the refrigerant.

As illustrated, the evaporator system 134 includes a first evaporator section 134 and a second evaporator section 136. The first and second evaporator sections 134, 136 couple together. In operation, the first and second evaporator sections 134, 136 may condition the supply air stream 122 (e.g., change the temperature and/or humidity of the supply air stream 122). The first evaporator section 134 may also be referred to as a primary cooling section. The second evaporator section 136 forms part of the supplemental heating and cooling system 120 and may therefore be referred to as a supplemental cooling and/or reheat section. Using the second evaporator section 136, the supplemental heating and cooling system 120 is able to control/fine-tune the characteristics of the supply air stream 122 exiting the vapor compression system 118. For example, if the supply air stream 122 is too humid and/or too cold the vapor compression system 118 may use the second evaporator section 136 of the evaporator system 132 to reheat and/or dry the supply air stream 122 before it exits the vapor compression system 118. In a different situation, the supply air stream 122 may need additional cooling, and the second evaporator section 136 of the evaporator system 132 may therefore be activated to provide additional cooling of the supply air stream 122. As will be explained below, by switching the direction of refrigerant flow through the second evaporator section 136, the second evaporator section 136 may either cool or reheat.

As illustrated, the condenser 130 feeds refrigerant to the first evaporator section 134 of the evaporator system 132 through line 138. As the refrigerant flows through line 138, the refrigerant passes through an expansion valve or device 140. The expansion valve 140 reduces the pressure of the refrigerant, which lowers its temperature. The refrigerant then passes through one or more coils in the first evaporator section 134 to remove energy from the supply air stream 122. As the refrigerant flows through the first evaporator section 134, the refrigerant evaporates as it absorbs energy, such as heat from the supply air stream 122. The refrigerant then exits the first evaporator section 134 and is returned through return line 142 to the compressor 124, which again compresses and drives refrigerant through the refrigeration loop.

The second evaporator section 136 is similarly fed by the condenser 130. However, the supplemental heating and cooling system 120 may use the second evaporator section 136 to either reheat or provide supplemental cooling of the supply air stream 122. The supplemental heating and cooling system 120 may do this using first and second flow paths/lines 144, 146 that enable the second evaporator section 136 to operate in a reheat or cooling mode.

In the reheat mode, the supplemental heating and cooling system 120 uses the first flow path/line 144 to route refrigerant from the condenser 130 directly into the second evaporator section 136. Because the refrigerant does not flow through an expansion valve before entering the second evaporator section 136, the refrigerant has a temperature greater than the supply air stream 122 entering the second evaporator section 136. This enables the refrigerant to heat the supply air stream 122. In the second evaporator section 136, the refrigerant flows through one or more coils. As it flows through the one or more coils, the refrigerant exchanges energy with the supply air stream 122 (i.e., loses energy). The refrigerant then exits the second evaporator section 136 at a lower temperature than when it entered, and the supply air stream 122 is reheated.

After exiting the second evaporator section 136, the refrigerant may be diverted into the first evaporator section 134 of the evaporator system 132 to provide additional cooling. For example, the first flow path 144 may include an expansion valve 148 that lowers the pressure and thus the temperature of the refrigerant before it enters the first evaporator section 134. In some embodiments, instead of routing the refrigerant to the first evaporator section 134, the first flow path 144 may route the refrigerant directly to the return line 142. In still another embodiment, the first flow path 144 may couple to the first evaporator section 134 of the evaporator system 132 as well as to the return line 142. In order to control how much of the refrigerant exiting the second evaporator section 136 is directed to the first evaporator section 134 and to the return line 142, the first flow path 144 may include a modulating valve. In operation, the modulating valve may change the amount of refrigerant flowing through the first flow path 144 to the first evaporator section 134 or to the return line 142 after exiting the second evaporator section 136.

As mentioned above, the second flow path 146 enables the second evaporator section 136 of the evaporator system 132 to operate in a cooling mode. Similar to the first flow path 144, the refrigerant exits the condenser 130 and flows to the second evaporator section 136. However, the second flow path 146 routes the refrigerant through an expansion valve 150 to reduce the temperature of the refrigerant before the refrigerant enters the second evaporator section 136. The refrigerant flowing through the second flow path 146 therefore has a lower temperature than the supply air stream 122 entering the second evaporator section 136 of the evaporator system 132. In the second evaporator section 136, the refrigerant flows through one or more coils enabling the refrigerant to absorb energy from the supply air stream 122. After passing through the second evaporator section 136, the refrigerant enters the return line 142, which redirects the refrigerant back to the compressor 124 to begin the refrigeration loop again.

In order to switch the second evaporator section 136 between reheating and cooling modes, the supplemental heating and cooling system 120 includes a valve system 152. In some embodiments, the valve system 152 may include first and second valves 154, 156 for controlling the refrigerant flow through the first flow path 144, while the third and fourth valves 158, 160 control the flow of refrigerant through the second flow path 146. The first valve 154 and the third valve 158 are positioned in the respective flow paths 144 and 146 to block or enable the flow refrigerant into the second evaporator section 136, while the second valve 156 and forth valve 160 are positioned in respective flow paths 144 and 146 to block or enable the flow refrigerant out of the second evaporator section 136. This enables the vapor compression system 118 to operate the second evaporator section 136 in either a reheat mode or a cooling mode. More specifically, with first and second valves 154, 156 open and the third and fourth valves 158, 160 closed, refrigerant can flow through the first flow path 144 in the reheat mode while blocking the flow of refrigerant through the second flow path 146 (i.e., block the second evaporator section 136 from operating in a supplemental cooling mode). Likewise, when the third and fourth valves 158, 160 are open and the first and second valves 154, 156 are closed, the second evaporator section 136 operates in the supplemental cooling mode (i.e., block the second evaporator section 136 from operating in a reheat mode).

In some embodiments, the valves 152 may be solenoid valves that couple to a controller 162. The controller 162 may include one or more memories 164 and one or more processors 166. In operation, the one or more processors 166 execute instructions stored on the one or more memories 164 to control the opening and closing of the valves in the valve system 152. For example, the controller 162 may couple to one or more sensors 168 (e.g., temperature sensors, humidity sensors) that provide feedback about the supply air stream 122 exiting the evaporator system 132 (e.g., the first evaporator section 134, the second evaporator section 136, etc.). As the controller 162 receives feedback, the controller 162 may open and close the valves in the valve system 152 to switch the second evaporator section 136 between reheat and supplemental cooling modes. For example, if the controller 162 receives feedback indicating that the supply air stream 122 is too cold and/or too humid, the controller 162 may open first and second valves 154 and 156 enabling refrigerant to flow through the first flow path 144 to operate the second evaporator section 136 in a reheat mode. In the reheat mode, the second evaporator section 136 increases the temperature and/or reduces humidity of the supply air stream 122 exiting the evaporator system 132. Likewise, if the controller 162 receives feedback indicating that the supply air stream 122 is too warm, the controller 162 may open the third and fourth valves 158 and 160 enabling refrigerant to flow through the second flow path 146 to operate the second evaporator section 136 in a supplemental cooling mode. In the cooling mode, the second evaporator section 136 decreases the temperature of the supply air stream 122 exiting the evaporator system 132.

Figure 6:
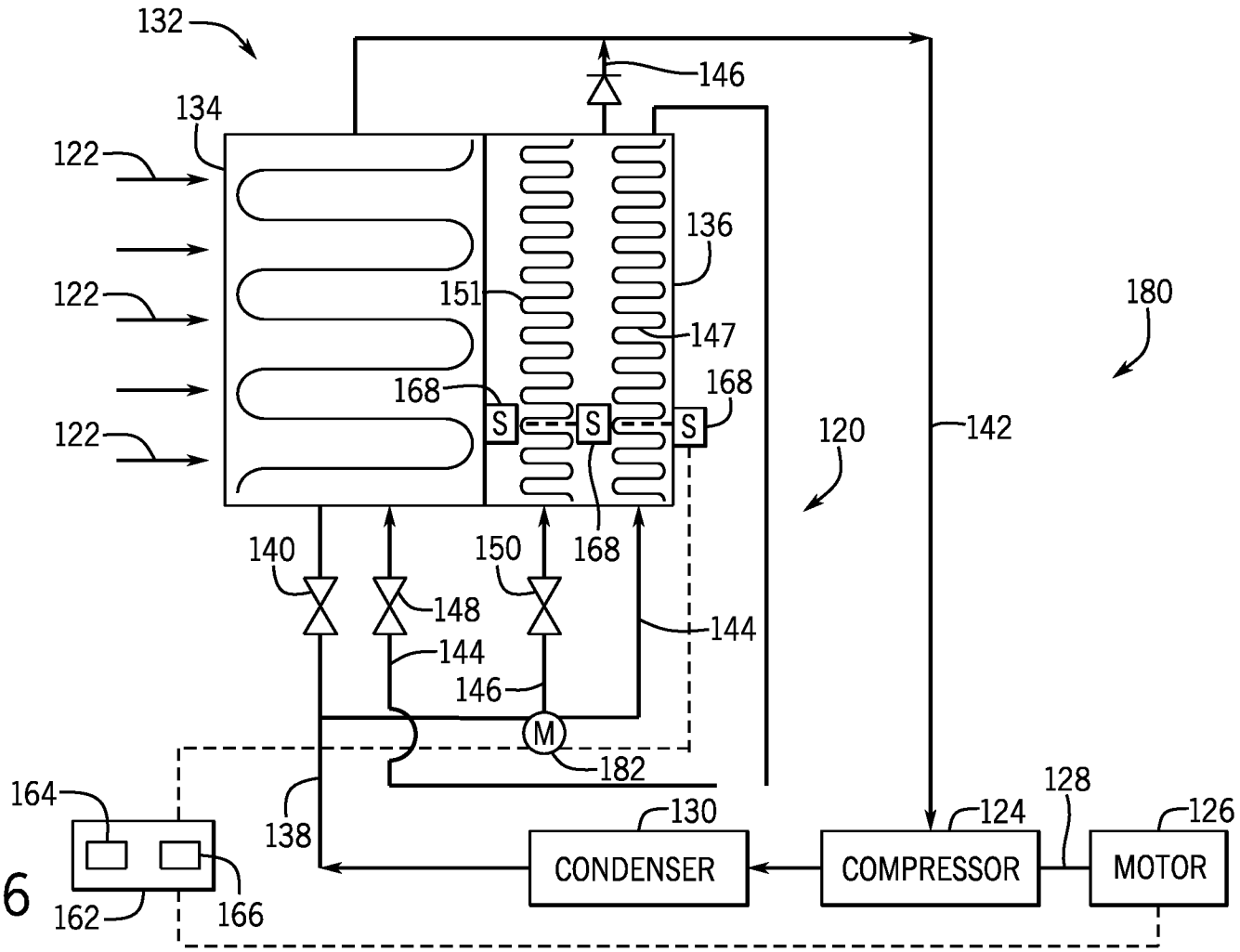
FIG. 6 is a schematic of an embodiment of the HVAC system, in accordance with an aspect of the present disclosure.

FIG. 6 is an embodiment of a vapor compression system 180 that may be used in any of the systems described above in FIGS. 1-4. The vapor compression system 180 includes the supplemental heating and cooling system 120 that enables the vapor compression system 180 to further control the characteristics (e.g., temperature, humidity) of the supply air stream 122.

In operation, the vapor compression system 180 circulates a refrigerant in a refrigeration loop to cool the supply air stream 122. The refrigeration loop begins with the compressor 124 that compresses and drives refrigerant through the refrigeration loop using power generated by the motor 126. After passing through the compressor 124, the refrigerant flows to the condenser 130. In the condenser 130, the refrigerant rejects heat enabling the refrigerant to condense and change state from a gas to a liquid. The refrigerant then exits the condenser 130 for use in the evaporator system 132. It is in the evaporator system 132 that the vapor compression system 180 changes the temperature of the supply air stream 122 through heat transfer between the supply air stream 122 and the refrigerant.

As similarly described above, the evaporator system 132 includes the first evaporator section 134 and the second evaporator section 136. As illustrated, the first and second evaporator sections 134, 136 couple together. In operation, the first and second evaporator sections 134, 136 may condition the supply air stream 122 (e.g., change the temperature and/or humidity of the supply air stream 122). The first evaporator section 134 may also be referred to as a primary cooling section. The second evaporator section 136 forms part of the supplemental heating and cooling system 120 and may therefore be referred to as a supplemental cooling and/or reheat section. By including the second evaporator section 136, the supplemental heating and cooling system 120 is able to control/fine-tune the characteristics of the supply air stream 122 exiting the vapor compression system 180. For example, if the supply air stream 122 is too humid and/or too cold, the vapor compression system 118 may use the second evaporator section 136 of the evaporator system 132 to reheat and/or dry the supply air stream 122 before it exits the vapor compression system 118. In contrast, if the supply air stream 122 needs additional cooling, the second evaporator section 136 of the evaporator system 132 may be activated to provide additional cooling of the supply air stream 122. In some applications, the second evaporator section 136 may simultaneously reheat and cool the supply air stream 122.

As illustrated, the condenser 130 feeds refrigerant to the first evaporator section 134 of the evaporator system 132 through line 138. As the refrigerant flows through line 138, the refrigerant passes through the expansion valve or device 140. The expansion valve 140 reduces the pressure of the refrigerant, which lowers its temperature. The refrigerant then passes through one or more coils in the first evaporator section 134 to remove energy or heat from the supply air stream 122. As the refrigerant flows through the first evaporator section 134, the refrigerant evaporates and changes states from a liquid to a gas. Refrigerant exits the first evaporator section 134 and is returned through return line 142 to the compressor 124, which again compresses and drives refrigerant through the refrigeration loop.

The second evaporator section 136 is similarly fed by the condenser 130. However, the supplemental heating and cooling system 120 may use the second evaporator section 136 for either reheating and/or supplemental cooling of the supply air stream 122. In order to do this, the supplemental heating and cooling system 120 includes first and second flow paths/lines 144, 146 that enable the second evaporator section 136 to operate in a reheat and/or cooling mode.

In the reheat mode, the supplemental heating and cooling system 120 uses the first flow path/line 144 to route refrigerant from the condenser 130 directly into the second evaporator section 136. Because the refrigerant does not flow through an expansion valve before entering the second evaporator section 136, the refrigerant is warmer than the supply air stream 122 entering the second evaporator section 136. This enables the refrigerant to reheat the supply air stream 122. Inside the second evaporator section 136, the refrigerant flows through one or more coils 147. As it flows through the one or more coils 147, the refrigerant exchanges energy with the supply air stream 122 (i.e., loses energy). After exchanging energy, the refrigerant exits the second evaporator section 136 at a lower temperature than when it entered. The refrigerant may then be diverted into the first evaporator section 134 of the evaporator system 132 to provide additional cooling. For example, the first flow path 144 may include the expansion valve 148 that lowers the pressure and thus the temperature of the refrigerant before it enters the first evaporator section 134.

In some embodiments, instead of routing the refrigerant to the first evaporator section 134, the first flow path 144 may route the refrigerant exiting the second evaporator section 136 directly to the return line 142. In still another embodiment, the first flow path 144 may couple to the first evaporator section 134 of the evaporator system 132 as well as to the return line 142. In order to control how much of the refrigerant exiting the second evaporator section 136 is directed to the first evaporator section 134 and to the return line 142, the first flow path 144 may include a modulating valve. In operation, the modulating valve may change the amount of refrigerant flowing through the first flow path 144 to the first evaporator section 134 or to the return line 142 after exiting the second evaporator section 136.

As explained above, the second flow path 146 enables the second evaporator section 136 of the evaporator system 132 to operate in a cooling mode. Similar to the first flow path 144, the refrigerant exits the condenser 130 and flows to the second evaporator section 136. However, the second flow path 146 routes the refrigerant through the expansion valve 150 to reduce the temperature of the refrigerant before the refrigerant enters the second evaporator section 136. The refrigerant flowing through the second flow path 146 therefore has a lower temperature than the supply air stream 122 entering the second evaporator section 136. In the second evaporator section 136, the refrigerant flows through one or more coils 151 enabling the refrigerant to absorb energy from the supply air stream 122. After passing through the second evaporator section 136, the refrigerant enters the return line 142, which directs the refrigerant back to the compressor 124 where the refrigeration loop starts again.

In order to adjust how much the second evaporator section 136 reheats and/or cools the vapor compression system 180 includes a modulating valve 182. The modulating valve 182 enables the vapor compression system 180 to increase and/or decrease refrigerant flow through coils 147 and/or 151, which in turn increases and/or decreases the amount reheating and supplemental cooling by the second evaporator section 136.

In some embodiments, the vapor compression system 180 may include the controller 162. The controller 162 may include one or more memories 164 and one or more processors 166. In operation, the one or more processors 166 execute instructions stored on the one or more memories 164 to control operation of the modulating valve 182. For example, the controller 162 may couple to one or more sensors 168 (e.g., temperature sensors, humidity sensors) that provide feedback about the supply air stream 122 exiting the evaporator system 132 (e.g., the first evaporator section 134, the second evaporator section 136, etc.). As the controller 162 receives feedback, the controller 162 controls how much refrigerant flows through the first and second flow path 144, 146 using the modulating valve 182. For example, if the controller 162 may receive feedback indicating that the supply air stream 122 is too cold and/or too humid, the controller 162 then controls the modulating valve 182 to increase the flow of refrigerant through the first flow path 144 to increase reheating of the supply air stream 122. Likewise, if the controller 162 receives feedback indicating that the supply air stream 122 is too warm, the controller 162 controls the modulating valve 182 to increase the flow refrigerant through the second flow path 146. It should be understood that the modulating valve 182 may completely shut off the first flow path 144 or the second flow path 146 in addition to varying the amount of refrigerant simultaneously flowing through the first and second flow paths 144, 146.

Figure 7:
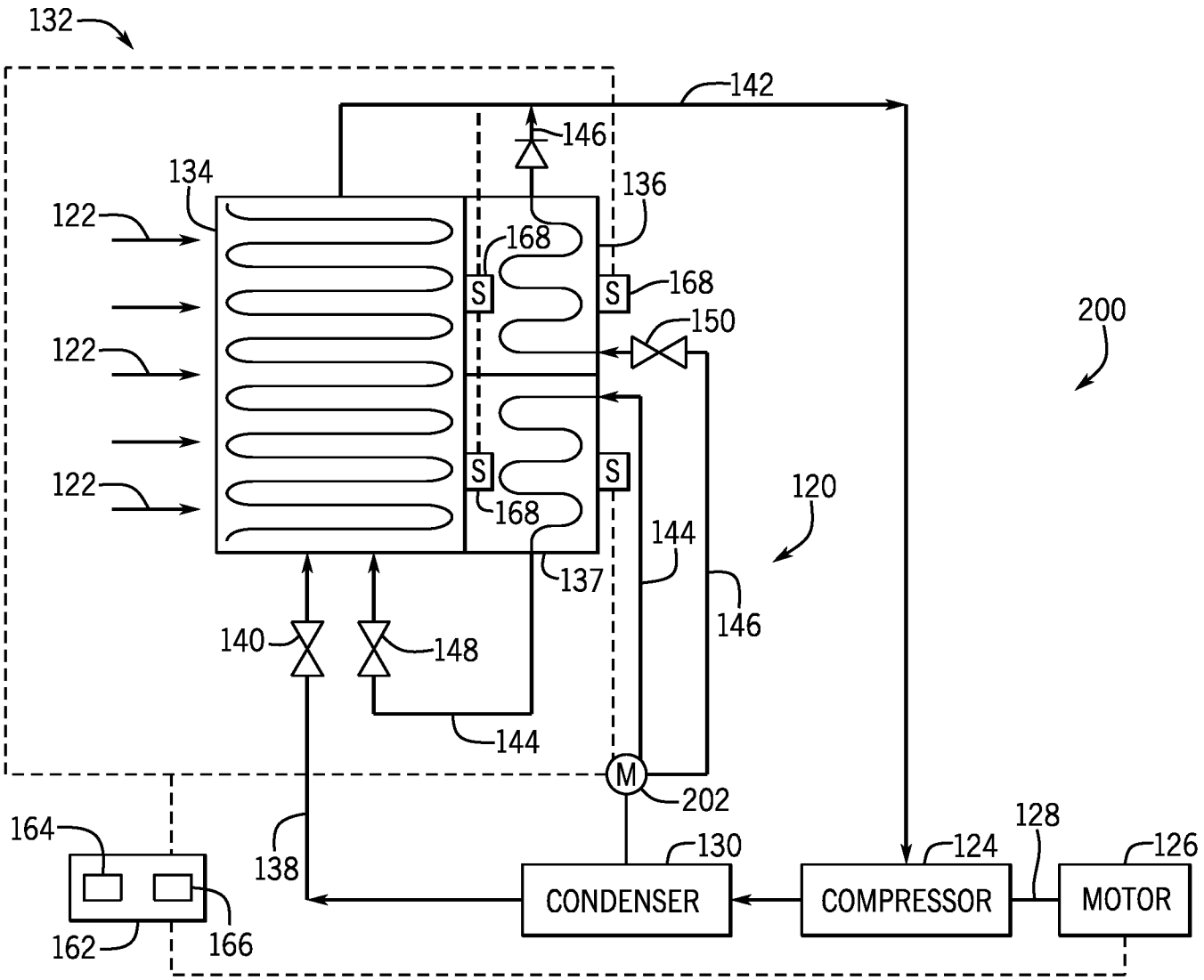
FIG. 7 is a schematic of an embodiment of the HVAC system, in accordance with an aspect of the present disclosure.

FIG. 7 is an embodiment of a vapor compression system 200 that may be used in any of the systems described above in FIGS. 1-4. As will be described below, the vapor compression system 200 includes the supplemental heating and cooling system 120 that enables the vapor compression system 200 to control the characteristics (e.g., temperature, humidity) of the supply air stream 122.

In operation, the vapor compression system 200 circulates a refrigerant in a refrigeration loop to cool the supply air stream 122. The refrigeration loop begins with the compressor 124 that compresses and drives refrigerant through the refrigeration loop using power generated by the motor 126. After passing through the compressor 124, the refrigerant flows to the condenser 130. In the condenser 130, the refrigerant rejects heat, thereby enabling the refrigerant to condense and change state from a gas to a liquid. The refrigerant then exits the condenser 130 for use in the evaporator system 132.

The evaporator system 132 includes the first evaporator section 134, the second evaporator section 136, and a third evaporator section 137. As illustrated, the first, second, and third evaporator sections 134, 136, and 137 couple together. Accordingly, as the supply air stream 122 flows into the evaporator system 132, a portion of it passes through the second evaporator section 136 and another portion passes through the third evaporator section 137. The second evaporator section 136 and the third evaporator section 137 may be the same size or have different sizes. For example, the second evaporator section 136 may be larger than the third evaporator section 137. In some embodiments, the third evaporator section 137 may be larger than the second evaporator section 136. In some embodiments, the sizes of the second and third evaporator sections 136, 137 may affect the amount of supplemental cooling and/or reheating of the supply air stream 122 passing through the evaporator system 132. In operation, the second evaporator section 136 and the third evaporator section 137 enable the vapor compression system 200 to control/fine-tune the characteristics of the supply air stream 122 exiting the vapor compression system 200.

As illustrated, the condenser 130 feeds refrigerant to the first evaporator section 134 of the evaporator system 132 through line 138. As the refrigerant flows through line 138, the refrigerant passes through the expansion valve or device 140. The expansion valve 140 reduces the pressure of the refrigerant, which lowers its temperature. The refrigerant then passes through one or more coils in the first evaporator section 134. As a refrigerant flows through the first evaporator section 134, the refrigerant absorbs energy and evaporates. The refrigerant then exits the first evaporator section 134 and is returned through return line 142 to the compressor 124.

The second evaporator section 136 and the third evaporator section 137 are similarly fed by the condenser 130. However, the supplemental heating and cooling system 120 uses the second evaporator section 136 to provide supplemental cooling of the supply air stream 122 while the third evaporator section 137 reheats. In order to do this, the vapor compression system 200 includes first and second flow paths/lines 144, 146 that enable the second and third evaporator section 136, 137 to reheat and cool.

In order to reheat, the vapor compression system 200 uses the first flow path/line 144 to route refrigerant from the condenser 130 directly into the third evaporator section 137. Because the refrigerant does not flow through an expansion valve before entering the third evaporator section 137, the refrigerant is warmer than the supply air stream 122 entering the third evaporator section 137. This enables the refrigerant to heat the supply air stream 122. Inside the third evaporator section 137, the refrigerant flows through one or more coils. As it flows through the one or more coils the refrigerant exchanges energy with the supply air stream 122 (i.e., loses energy).

After exchanging energy, the refrigerant exits the third evaporator section 137 at a lower temperature than when it entered. The refrigerant may then be diverted into the first evaporator section 134 of the evaporator system 132 to provide additional cooling. For example, the first flow path 144 may include the expansion valve 148 that lowers the pressure and thus the temperature of the refrigerant before it enters the first evaporator section 134. In some embodiments, instead of routing the refrigerant to the first evaporator section 134, the first flow path 144 may route the refrigerant exiting the third evaporator section 137 directly to the return line 142. In still another embodiment, the first flow path 144 may couple to the first evaporator section 134 of the evaporator system 132 as well as to the return line 142. In order to control how much of the refrigerant exiting the third evaporator section 137 is directed to the first evaporator section 134 and to the return line 142 the first flow path 144 may include a modulating valve. In operation, the modulating valve may change the amount of refrigerant flowing through the first flow path 144 to the first evaporator section 134 or to the return line 142 after exiting one or more coils 147 in the second evaporator section 136.

The second flow path 146 enables the second evaporator section 136 of the evaporator system 132 to provide supplemental cooling. Similar to the first flow path 144, the refrigerant exits the condenser 130 and flows to the second evaporator section 136. However, the second flow path 146 routes the refrigerant through an expansion valve 150 to reduce the temperature of the refrigerant before the refrigerant enters the second evaporator section 136. The refrigerant flowing through the second flow path 146 therefore has a lower temperature than the supply air stream 122 entering the second evaporator section 136. In the second evaporator section 136, the refrigerant flows through one or more coils enabling the refrigerant to absorb energy from the supply air stream 122. After passing through the second evaporator section 136, the refrigerant enters the return line 142, which directs the refrigerant back to the compressor 124 where the refrigeration loop starts again.

In order to adjust how much the second and third evaporator sections 136, 137 reheat and cool, the vapor compression system 200 includes a modulating valve 202. The modulating valve 182 enables the vapor compression system 200 to increase and/or decrease refrigerant flow through the second and third evaporator sections 136, 137, which in turn increase and/or decrease the amount reheating and supplemental cooling by the respective second and third evaporator sections 136, 137.

In some embodiments, the vapor compression system 200 may include the controller 162. The controller 162 may include one or more memories 164 and one or more processors 166. In operation, the one or more processors 166 execute instructions stored on the one or more memories 164 to control operation of the modulating valve 202. For example, the controller 162 may couple to one or more sensors 168 (e.g., temperature sensors, humidity sensors) that provide feedback about the supply air stream 122 exiting the evaporator system 132 (e.g., the first evaporator section 134, the second evaporator section 136, the third evaporator section 137, etc.). As the controller 162 receives feedback, the controller 162 controls how much refrigerant flows through the first and second flow path 144, 146 using the modulating valve 202. For example, if the controller 162 receives feedback indicating that the supply air stream 122 is too cold and/or too humid, the controller 162 controls the modulating valve 22 to increase the flow of refrigerant through the first flow path 144 to increase reheating of the supply air stream 122 with the third evaporator section 137. Likewise, if the controller 162 receives feedback indicating that the supply air stream 122 is too warm, the controller 162 controls the modulating valve 182 to increase the flow refrigerant through the second flow path 146 to the second evaporator section 136. It should be understood that the modulating valve 202 may completely shut off the first flow path 144 or the second flow path 146 in addition to varying the amount of refrigerant flowing simultaneously through the first and second flow paths 144, 146.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the present disclosure, or those unrelated to enabling the claimed subject matter). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A vapor compression system, comprising:

an evaporator system configured to change a temperature of a fluid flowing across the evaporator system using a refrigerant, the evaporator system comprising:

a first evaporator section configured to cool the fluid as the fluid flows through the first evaporator section using the refrigerant;

a second evaporator section configured to alternatively cool and heat or simultaneously cool and heat the fluid as the fluid flows through the second evaporator section with the refrigerant, the second evaporator section comprising:

a first flow path configured to heat the fluid as the fluid flows across the evaporator system with the refrigerant;

a second flow path configured to cool the fluid as the fluid flows across the evaporator system with the refrigerant; and a modulating valve fluidly coupled to the first and second flow paths and configured to control flow of the refrigerant through the first and second flow paths.

2. The system of claim 1, wherein the first evaporator section and the second evaporator section are coupled together.

3. The system of claim 2, wherein the second evaporator section is downstream of the first evaporator section in a direction that the fluid flows.

4. The system of claim 1, wherein the first flow path comprises an expansion valve downstream of the second evaporator section and upstream of the first evaporator section in a direction that the refrigerant flows.

5. The system of claim 1, comprising a controller configured to control the modulating valve to control a first amount of the refrigerant flowing through the first path and a second mount of the refrigerant flowing through the second flow path.

6. The system of claim 5, wherein the controller couples to at least one sensor and is configured to use feedback from the at least one sensor to control the modulating valve.

* * * * *